US007305341B2

(12) United States Patent
Kim

(10) Patent No.: US 7,305,341 B2
(45) Date of Patent: Dec. 4, 2007

(54) METHOD OF REFLECTING TIME/LANGUAGE DISTORTION IN OBJECTIVE SPEECH QUALITY ASSESSMENT

(75) Inventor: Doh-Suk Kim, Basking Ridge, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 445 days.

(21) Appl. No.: 10/603,212

(22) Filed: Jun. 25, 2003

(65) Prior Publication Data

US 2004/0267523 A1 Dec. 30, 2004

(51) Int. Cl.
*G10L 11/00* (2006.01)

(52) U.S. Cl. ..... 704/259; 704/200.1

(58) Field of Classification Search ..... None
See application file for complete search history.

(56) References Cited

U.S. PATENT DOCUMENTS 3,971,034 A * 7/1976 Bell et al. ..... 346/33 R
5,313,556 A * 5/1994 Parra ..... 704/246
5,454,375 A * 10/1995 Rothenberg ..... 600/538
5,794,188 A * 8/1998 Hollier ..... 704/228
5,799,133 A * 8/1998 Hollier et al. ..... 706/25
5,848,384 A * 12/1998 Hollier et al. ..... 704/231
6,035,270 A * 3/2000 Hollier et al. ..... 704/202
6,052,662 A * 4/2000 Hogden ..... 704/256.2
6,119,083 A * 9/2000 Hollier et al. ..... 704/243
6,246,978 B1 * 6/2001 Hardy ..... 704/201
6,609,092 B1 * 8/2003 Ghitza et al. ..... 704/226
2004/0002852 A1 * 1/2004 Kim ..... 704/205
2004/0002857 A1 * 1/2004 Kim ..... 704/222
2004/0267523 A1 * 12/2004 Kim ..... 704/205

FOREIGN PATENT DOCUMENTS

DE 198 40 548 3/2000
WO WO 02/43051 5/2002

OTHER PUBLICATIONS

European Search Report.

* cited by examiner

*Primary Examiner*—Donald L. Storm

(57) ABSTRACT

Disclosed is an objective speech quality assessment technique that reflects the impact of distortions which can dominate overall speech quality assessment by modeling the impact of such distortions on subjective speech quality assessment, thereby, accounting for language effects in objective speech quality assessment.

16 Claims, 5 Drawing Sheets

METHOD OF REFLECTING TIME/LANGUAGE DISTORTION IN OBJECTIVE SPEECH QUALITY ASSESSMENT

FIELD OF THE INVENTION

The present invention relates generally to communications systems and, in particular, to speech quality assessment.

BACKGROUND OF THE RELATED ART

Performance of a wireless communication system can be measured, among other things, in terms of speech quality. In the current art, there are two techniques of speech quality assessment. The first technique is a subjective technique (hereinafter referred to as "subjective speech quality assessment"). In subjective speech quality assessment, human listeners are typically used to rate the speech quality of processed speech, wherein processed speech is a transmitted speech signal which has been processed at the receiver. This technique is subjective because it is based on the perception of the individual human, and human assessment of speech quality by native listeners, i.e., people that speak the language of the speech material being presented or listened, typically takes into account language effects. Studies have shown that a listener's knowledge of language affects the scores in subjective listening tests. Scores given by native listeners when lower in subjective listening tests compared to scores given by non-native listeners when language information in speech is defect, i.e., mute. In a normal telephone conversation, the listener is often a native listener. Thus, it is preferable to use native listeners for subjective speech quality assessment in order to emulate typical conditions. Subjective speech quality assessment techniques provide a good assessment of speech quality but can be expensive and time consuming.

The second technique is an objective technique (hereinafter referred to as "objective speech quality assessment"). Objective speech quality assessment is not based on the perception of the individual human. Some objective speech quality assessment techniques are based on known source speech or reconstructed source speech estimated from processed speech. Other objective speech quality assessment techniques are not based on known source speech but on processed speech only. These latter techniques are referred to herein as "single-ended objective speech quality assessment techniques" and are often used when known source speech or reconstructed source speech are unavailable.

Current single-ended objective speech quality assessment techniques, however, do not provide as good an assessment of speech quality compared to subjective speech quality assessment techniques. One reason why current single-ended objective speech quality assessment techniques are not as good as subjective speech quality assessment techniques is because the former techniques do not account for language effects. Current single-ended objective speech quality assessment techniques have been unable to account for language effects in its speech assessment.

Accordingly, there exists a need for a single-ended objective speech quality assessment technique which accounts for language effects in assessing speech quality.

SUMMARY OF THE INVENTION

The present invention is an objective speech quality assessment technique that reflects the impact of distortions which can dominate overall speech quality assessment by modeling the impact of such distortions on subjective speech quality assessment, thereby, accounting for language effects in objective speech quality assessment. In one embodiment, the objective speech quality assessment technique of the present invention comprises the steps of detecting distortions in an interval of speech activity using envelope information, and modifying an objective speech quality assessment value associated with the speech activity to reflect the impact of the distortions on subjective speech quality assessment. In one embodiment, the objective speech quality assessment technique also distinguish types of distortions, such as short bursts, abrupt stops and abrupt starts, and modifies the objective speech quality assessment values to reflect the different impacts of each type of distortion on subjective speech quality assessment.

BRIEF DESCRIPTION OF THE DRAWINGS

The features, aspects, and advantage of the present invention will become better understood with regard to the following description, appended claims, and accompanying drawings where:

DETAILED DESCRIPTION

The present invention is an objective speech quality assessment technique that reflects the impact of distortions which can dominate overall speech quality assessment by modeling the impact of such distortions on subjective speech quality assessment, thereby, accounting for language effects in objective speech quality assessment.

Figure 1:
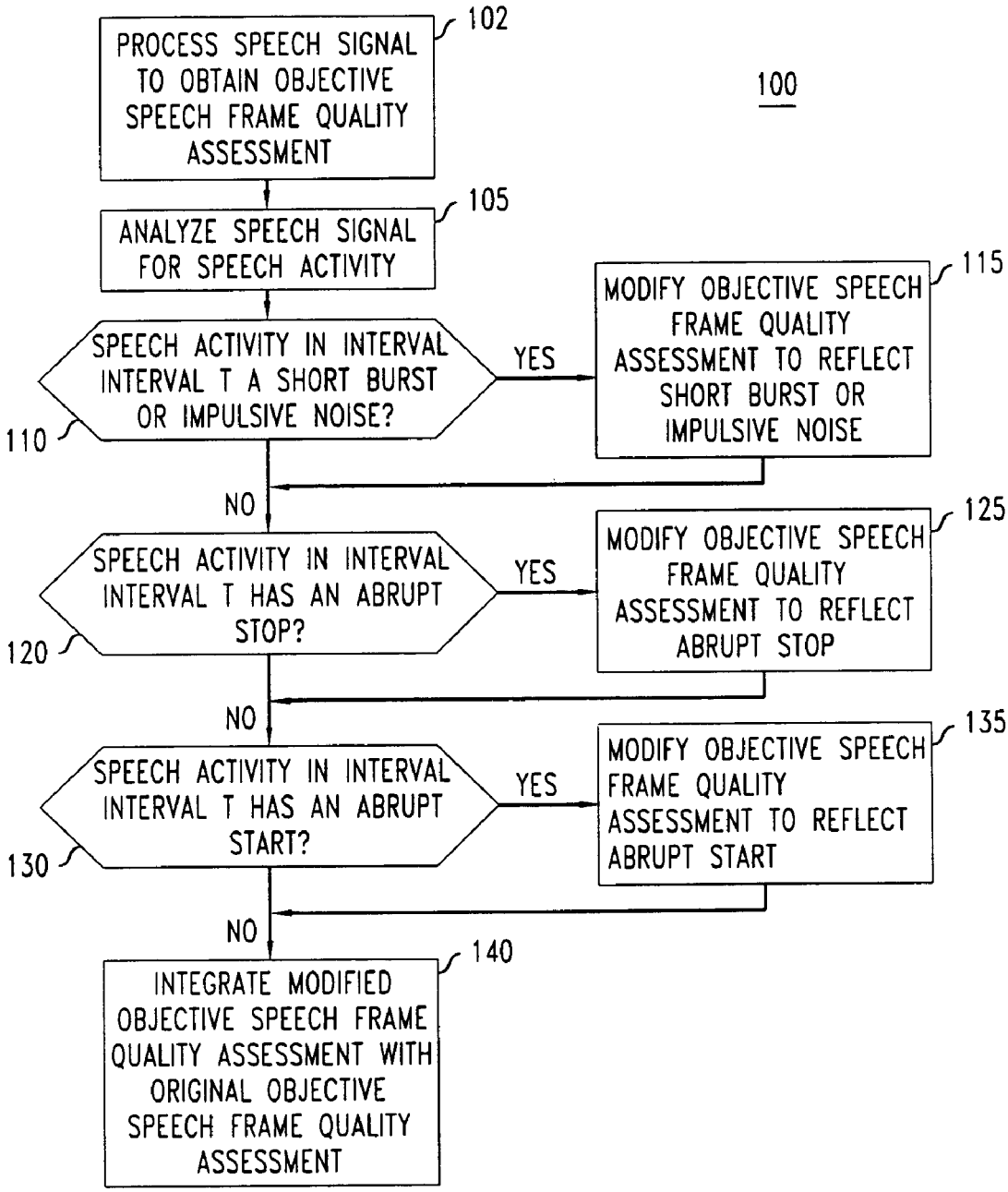
FIG. 1 depicts a flowchart illustrating an objective speech quality assessment technique according for language effects in accordance with one embodiment of the present invention.

FIG. 1 depicts a flowchart 100 illustrating an objective speech quality assessment technique accounting language effects in accordance with one embodiment of the present invention. In step 102, speech signal s(n) is processed to determine objective speech frame quality assessment $v_s(m)$, i.e., objective quality of speech at frame m. In one embodiment, each frame m corresponds to a 64 ms interval. The manner of processing a speech signal s(n) to obtain objective speech frame quality assessment $v_s(m)$ (which do not account for language effects) is well-known in the art. One example of such processing is described in co-pending application Ser. No. 10/186,862, entitled "Compensation Of Utterance-Dependent Articulation For Speech Quality Assessment", filed on Jul. 1, 2002 by inventor Doh-Suk Kim, which is being incorporated herein by reference.

Figure 2:
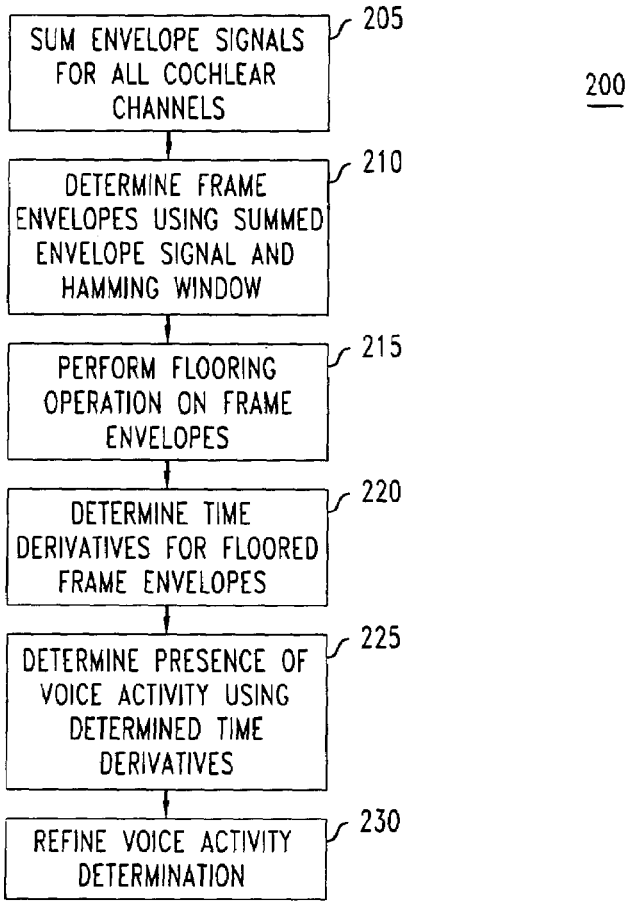
FIG. 2 depicts a flowchart illustrating a voice activity detector (VAD) which detects voice activity by examining envelope information associated with the speech signal in accordance with one embodiment of the present invention.

In step 105, speech signal s(n) is analyzed for voice activity by, for example, a voice activity detector (VAD). VADs are well-known in the art. FIG. 2 depicts a flowchart 200 illustrating a VAD which detects voice activity by examining envelope information associated with the speech signal in accordance with one embodiment of the present invention. In step 205, envelope signals $\gamma_k(n)$ are summed up for all cochlear channels k to form summed envelope signal γ(n) in accordance with equation (1):

$$\gamma(n) = \sum_{k=1}^{N_{cb}} \gamma_k(n) \qquad \text{equation (1)}$$

where $$\gamma_k(n) = \sqrt{s_k^2(n) + \hat{s}_k^2(n)},$$

n represent a time index, $N_{cb}$ represents a total number of critical bands, $s_k(n)$ represents the output of speech signal s(n) through cochlear channel k, i.e., $s_k(n)=s(n)*h_k(n)$, and $\hat{s}_k(n)$ is the Hilbert transform of $s_k(n)$.

In step 210, a frame envelope e(l) is computed every 2 ms by multiplying summed envelope signal γ(n) with a 4 ms Hamming window w(n) in accordance with equation (2):

$$e(l) = \log\left[\sum_{n=0}^{31} \gamma^{(l)}(n)w(n) + 1\right] \qquad \text{equation (2)}$$

where $\gamma^{(l)}(n)$ is the 2 ms l-th frame signal of the summed envelope signal γ(n). It should be understood that the durations of the frame envelope e(l) and Hamming window w(n) are merely illustrative and that other durations are possible. In step 215, a flooring operation is applied to frame envelope e(l) in accordance with equation (3).

$$e(l) = \begin{cases} e(l) & \text{if } e(l) > 5 \\ 5 & \text{otherwise} \end{cases} \qquad \text{equation (3)}$$

In step 220, time derivative Δe(l) of floored frame envelope e(l) is obtained in accordance with equation (4).

$$\Delta e(l) = \frac{\sum_{j=-3}^{3} je(l-j)}{\sum_{j=-3}^{3} j^2} \qquad \text{equation (4)}$$

where $-3 \leqq j \leqq 3$.

In step 225, voice activity detection is performed in accordance with equation (5).

$$vad(l) = \begin{cases} 1 & \text{if } e(l) > 5 \\ 0 & \text{otherwise} \end{cases} \qquad \text{equation (5)}$$

Figure 3:
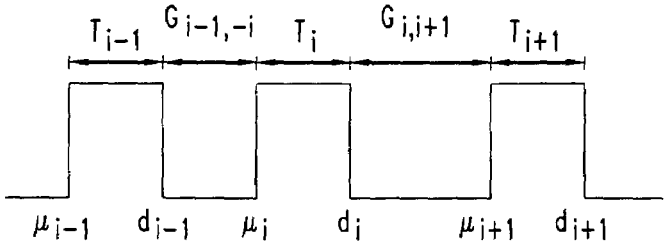
FIG. 3 depicts an example VAD activity diagram illustrating intervals T and G of speech and non-speech activities, respectively.

In step 230, the result of equation (5), i.e., vad(l), can then be refined based on the duration of 1's and 0's in the output. For example, if the duration of 0's in vad(l) is shorter than 8 ms, then vad(l) shall be changed to 1's for that duration. Similarly, if the duration of 1's in vad(l) is shorter than 8 ms, the vad(l) shall be changed to 0's for that duration. FIG. 3 depicts an example VAD activity diagram 30 illustrating intervals T and G of speech and non-speech activities, respectively. It should be understood that speech activities associated with intervals T may include, for example, actual speech, data or noise.

Returning to flowchart 100 of FIG. 1, upon analyzing speech signal s(n) for speech activity, interval T is examined to determined whether the associated speech activity corresponds to a short burst or impulsive noise in step 110. If the speech activity in interval T is determined to be a short burst or impulsive noise, then objective speech frame quality assessment $v_s(m)$ is modified in step 115 to obtain a modified objective speech frame quality assessment $\tilde{v}_s(m)$. The modified objective speech frame quality assessment $\tilde{v}_s(m)$ accounts for the effects of short burst or impulsive noise by modeling or simulating the impact of short bursts or impulsive noise on subjective speech quality assessment.

From step 115 of if in step 110 the speech activity in interval T is not determined to be a short burst or impulsive noise, then flowchart 100 proceeds to step 120 where the speech activity in interval T is examined to determine whether it has an abrupt stop or mute. If the speech activity in interval T is determined to have an abrupt stop or mute, then objective speech frame quality assessment $v_s(m)$ is modified in step 125 to obtain a modified objective speech frame quality assessment $\tilde{v}_s(m)$. The modified objective speech frame quality assessment $\tilde{v}_s(m)$ accounts for the effects of the abrupt stop or mute by modeling or simulating the impact of an abrupt stop or mute and subsequent release on subjective speech quality assessment.

From step 125 or if in step 120 the speech activity in interval T is not determined to have an abrupt stop or mute, then flowchart 100 proceeds to step 130 where the speech activity in interval T is examined to determine whether it has an abrupt start. If the speech activity in interval T is determined to have an abrupt start, then objective speech frame quality assessment $v_s(m)$ is modified in step 135 to obtain a modified objective speech frame quality assessment $\tilde{v}_s(m)$. The objective speech frame quality assessment $v_s(m)$ accounts for the effects of the abrupt start by modeling or simulating the impact of an abrupt start on subjective speech quality assessment. From step 135 or if in step 130 the speech activity in interval T is not determined to have an abrupt start, then flowchart 100 proceeds to step 145 where the results of modifications to objective speech frame quality assessment $v_s(m)$, if any, are integrated into the original objective speech frame quality assessment $v_s(m)$ of step 102.

Figure 4:
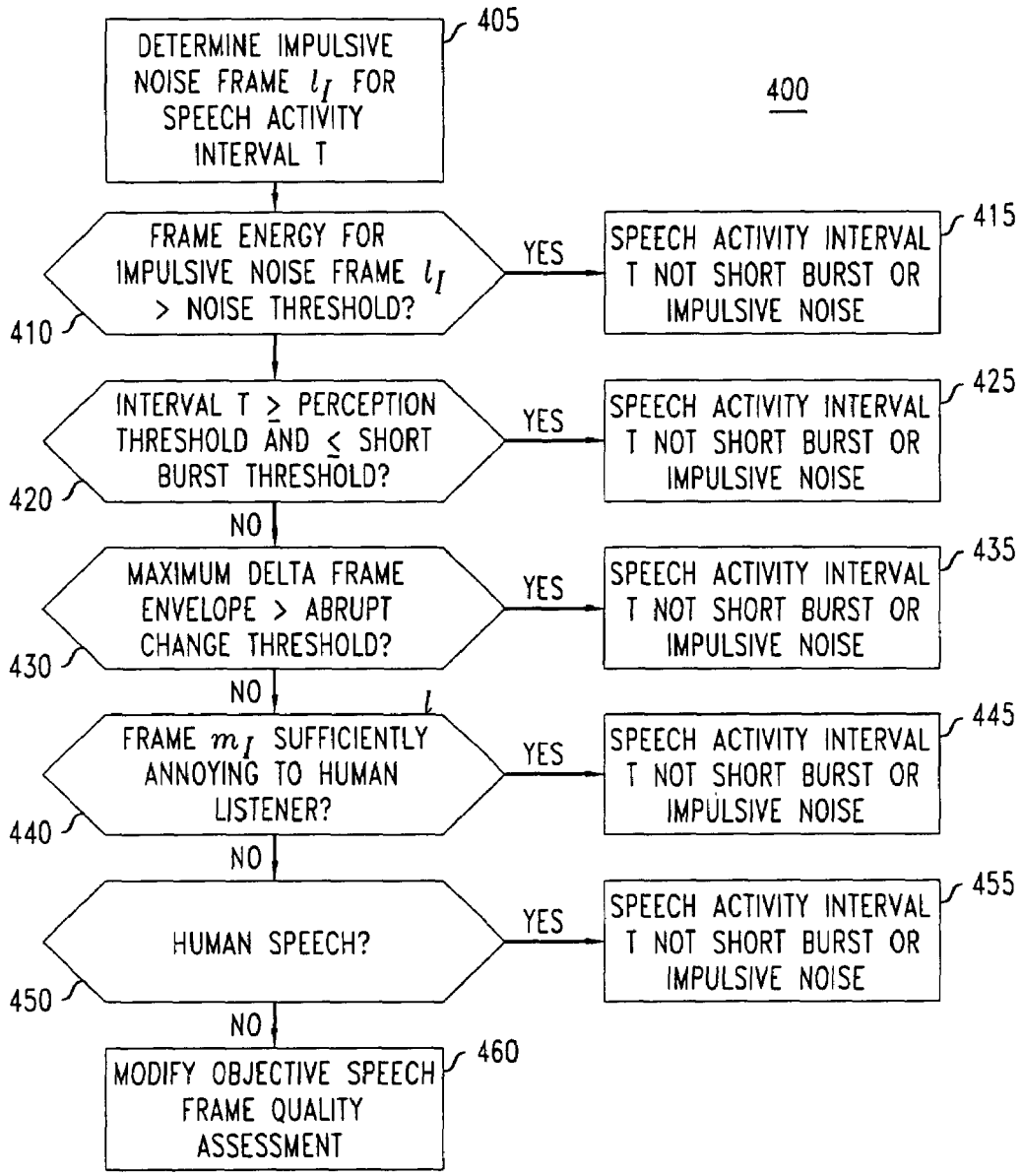
FIG. 4 depicts a flowchart illustrating an embodiment for determining whether speech activity is a short burst or impulsive noise and for modifying objective speech frame quality assessment $v_s(m)$ when a short burst or impulsive noise is determined.

Techniques for determining whether speech activity is a short burst (or impulsive noise) or has an abrupt stop (or mute) or an abrupt start, i.e., steps 110, 120 and 130, along with techniques for modifying objective speech frame quality assessment $v_s(m)$, i.e., steps 115, 125 and 135, in accordance with one embodiment of the invention will now be described. FIG. 4 depicts a flowchart 400 illustrating an embodiment for determining whether speech activity is a short burst or impulsive noise and for modifying objective speech frame quality assessment $v_s(m)$ when a short burst or impulsive noise is determined. In step 405, an impulsive noise frame $l_I$ is determined by finding a frame l in interval $T_i$ where frame envelope e(l) is maximum in accordance, for example, with equation (6):

$$l_I = \arg\max_{u_i \le l \le d_i} e(l) \qquad \text{equation (6)}$$

where $u_i$ and $d_i$ represents frames l at the beginning and end of interval $T_i$, respectively. In step 410, frame envelope $e(l_I)$ is compared to a listener threshold value indicating whether a human listener can consider the corresponding frame $l_I$ as annoying short burst. In one embodiment, the listener threshold value is 8—that is, in step 410, $e(l_I)$ is checked to determined whether it is greater than 8. If frame envelope $e(l_I)$ is not greater than the listener threshold value, then in step 415 the speech activity is determined not to be a short burst or impulsive noise.

If frame envelope $e(l_I)$ is greater than the listener threshold value, then in step 420 the duration of interval $T_i$ is checked to determine whether it satisfies both a short burst threshold value and a perception threshold value. That is, interval $T_i$ is being checked to determine whether interval $T_i$ is not too short to be perceived by a human listener and not too long to be categorized as a short burst. In one embodiment, if the duration of interval $T_i$ is greater than or equal to 28 ms and less than or equal to 60 ms, i.e., $28 \leqq T_i \leqq 60$, then both of the threshold values of step 420 are satisfied. Otherwise the threshold values of step 420 are not satisfied. If the threshold values of step 420 are not satisfied, then in step 425 the speech activity is determined not to be a short burst or impulsive noise.

If the threshold values of step 420 are satisfied, then in step 430 a maximum delta frame envelope Δe(l) is determined from the frame envelope e(l) in the one or more frames prior to the beginning of interval $T_i$ through the first one or more frames of interval $T_i$ and subsequently compared to an abrupt change threshold value, such as 0.25. The abrupt change threshold value representing a criteria for identifying an abrupt change in the frame envelope. In one embodiment, a maximum delta frame envelope Δe(l) is determined from frame envelope $e(u_i-1)$, i.e., frame envelope immediately preceding interval $T_i$, through the frame envelope $e(u_i+5)$, i.e., fifth frame envelope in interval $T_i$, and compared to a threshold value of 0.25—that is, in step 430, it is checked to determine whether equation (7) is satisfied:

$$\max_{u_i-1 \le l \le u_i+5} \Delta e(l) > 0.25 \qquad \text{equation (7)}$$

If the maximum delta frame envelope Δe(l) does not exceed the threshold value, then in step 435 the speech activity is determined not to be a short burst or impulsive noise.

If the maximum delta frame envelope Δe(l) does exceed the threshold value, then in step 440 it is determined whether frame $m_I$ would be sufficiently annoying to a human listener, where $m_I$ corresponds to the frame m which is impacted most by impulsive noise frame $l_I$. In one embodiment, step 440 is achieved by determining whether a ratio of objective speech frame quality assessment $v_s(m_I)$ to modulation noise reference unit $v_q(m_I)$ exceeds a noise threshold value. Step 440 may be expressed, for example, using a noise threshold value of 1.1 and equation (8):

$$\frac{v_s(m_I)}{v_q(m_I)} < 1.1 \qquad \text{equation (8)}$$

wherein if equation (8) is satisfied, it would be determined that frame $m_I$ has sufficient annoyance to a human listener. If it is determined that objective speech frame quality assessment $v_s(m_I)$ would be sufficiently annoying to a human listener, then in step 445 the speech activity is determined not to be a short burst or impulsive noise.

If it is determined that objective speech frame quality assessment $v_s(m_I)$ would not be sufficiently annoying to a human listener, then in step 450 conditions related to the durations of intervals $G_{i-1,i}$, $G_{i,i+1}$, $T_{i-1}$ and/or $T_{i+1}$ satisfying certain minimum or maximum duration threshold values are checked to verify that it belongs to human speech. In one embodiment, the conditions of step 450 are expressed as equations (9) and (10).

$$G_{i-1,i} < 180 \text{ ms and } G_{i,i+1} > 40 \text{ ms and } T_{i-1} > 50 \text{ ms} \qquad \text{equation (9)}$$

$$G_{i-1,i} > 40 \text{ ms and } G_{i,i+1} < 100 \text{ ms and } T_{i+1} > 60 \text{ ms} \qquad \text{equation (10)}$$

If any of these equations or conditions are satisfied, then in step 455 the speech activity is determined not to be a short burst or impulsive noise. Rather the speech activity is determined to be natural speech. It should be understood that the minimum and maximum duration threshold values used in equations (9) and (10) are merely illustrative and may be different.

If none of the conditions in step 450 are satisfied, then in step 460 objective speech frame quality assessment $v_s(m)$ is modified in accordance with equation 11:

$$\tilde{v}_s(m) = \frac{v_s(m)}{1 + \exp[-8.2(m - m_I)/e(l_I) - 10]} \qquad \text{equation (11)}$$

Figure 5:
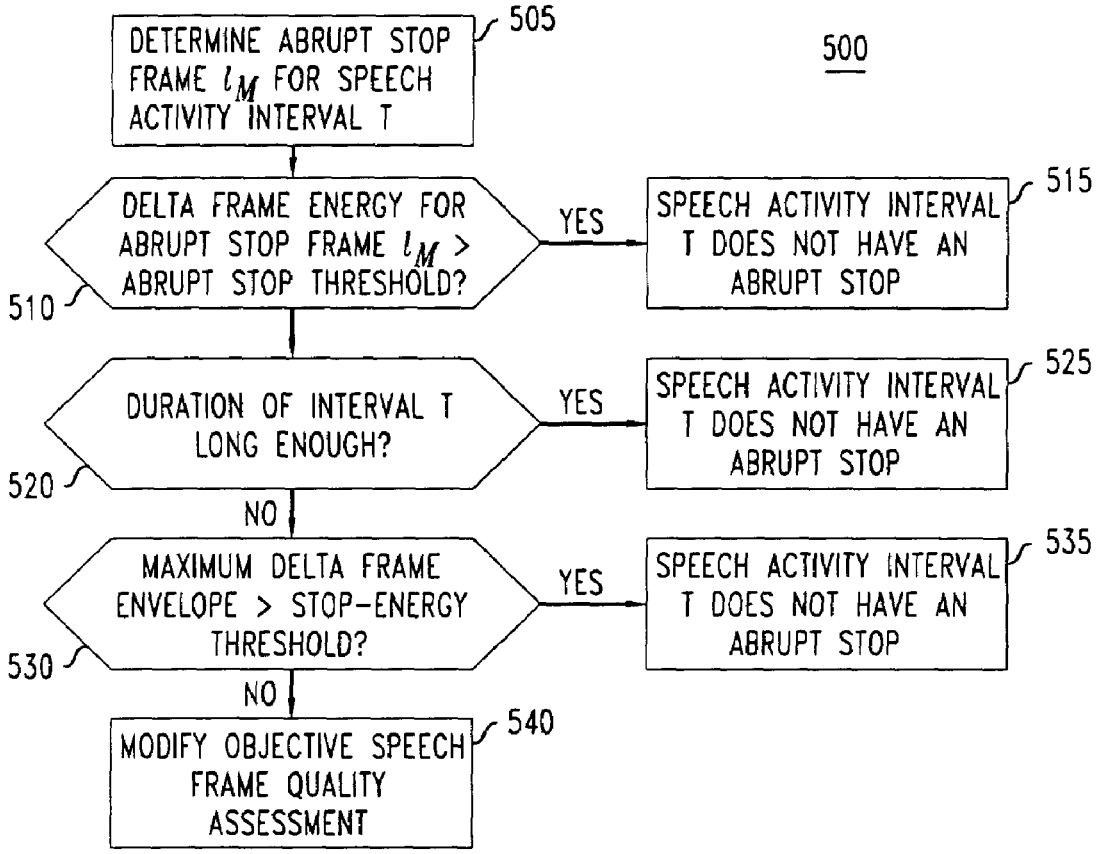
FIG. 5 depicts a flowchart illustrating an embodiment for determining whether speech activity has an abrupt stop or mute and for modifying objective speech frame quality assessment $v_s(m)$ when it is determined that such speech activity has an abrupt stop or mute.

FIG. 5 depicts a flowchart 500 illustrating an embodiment for determining whether speech activity has an abrupt stop or mute and for modifying objective speech frame quality assessment $v_s(m)$ when it is determined that such speech activity has an abrupt stop or mute. In step 505, abrupt stop frame $l_M$ is determined. The abrupt stop frame $l_M$ is determined by first finding negative peaks of delta frame envelope Δe(l) in the speech activity using all frames l in interval $T_i$. Delta frame envelope $\Delta e(l)$ has a negative peak at l if $\Delta e(l)<\Delta e(l+j)$ for $3 \leqq j \leqq 3$. Upon finding the negative peaks, abrupt stop frame $l_M$ is determined as the minimum of the negative peaks of delta frame envelope $\Delta e(l)$. In step 510, delta frame envelope $\Delta e(l_M)$ is checked to determined whether an abrupt stop threshold value is satisfied. The abrupt stop threshold representing a criteria for determining whether there was sufficient negative change in frame envelope from one frame l to another frame l+1 to be considered an abrupt stop. In one embodiment, the abrupt stop threshold value is −0.56 and step 510 may be expressed as equation (12):

$$\Delta e(l_M)<-0.56 \qquad \text{equation (12)}$$

If delta frame envelope $\Delta e(l_M)$ does not satisfy the abrupt stop threshold value, then in step 515 the speech activity is determined not to have an abrupt stop or mute.

If delta frame envelope $\Delta e(l_M)$ does satisfy the abrupt stop threshold value, then in step 520 interval $T_i$ is checked to determine if the speech activity is of sufficient duration, e.g., longer than a short burst. In one embodiment, the duration of interval $T_i$ is checked to see if it exceeds the duration threshold value, e.g., 60 ms. That is, if $T_i<60$ ms, then the speech activity associated with interval $T_i$ is not of sufficient duration. If the speech activity is considered not of sufficient duration, then in step 525 the speech activity is determined not to have an abrupt stop or mute.

If the speech activity is considered of sufficient duration, then in step 530 a maximum frame envelope e(l) is determined for one or more frames prior to frame $l_M$ through frame $l_M$ or beyond and subsequently compared against a stop-energy threshold value. The stop-energy threshold value representing a criteria for determining whether a frame envelope has sufficient energy prior to muting. In one embodiment, maximum frame envelope e(l) is determined for frame $l_M-7$ through $l_M$ and compared to a stop-energy threshold value of 9.5, i.e., $$\max_{l_m-7 \le l \le l_m} e(l) > 9.5.$$

If the maximum frame envelope e(l) does not satisfy the stop-energy threshold value, then in step 535 the speech activity is determined not to have an abrupt stop or mute.

If the maximum frame envelope e(l) does satisfy the stop-energy threshold value, then objective speech frame quality assessment $v_s(m)$ is modified in accordance with equation 13 for several frames m, such as $m_M, \ldots, m_M+6$:

$$\tilde{v}_s(m) = |\Delta e(l_M)|\left[\frac{6}{1+\exp[-2(m-m_M-3]} - 6\right] \qquad \text{equation (13)}$$

where $m_M$ corresponds to the frame m which is impacted most by abrupt stop frame $l_M$.

Figure 6:
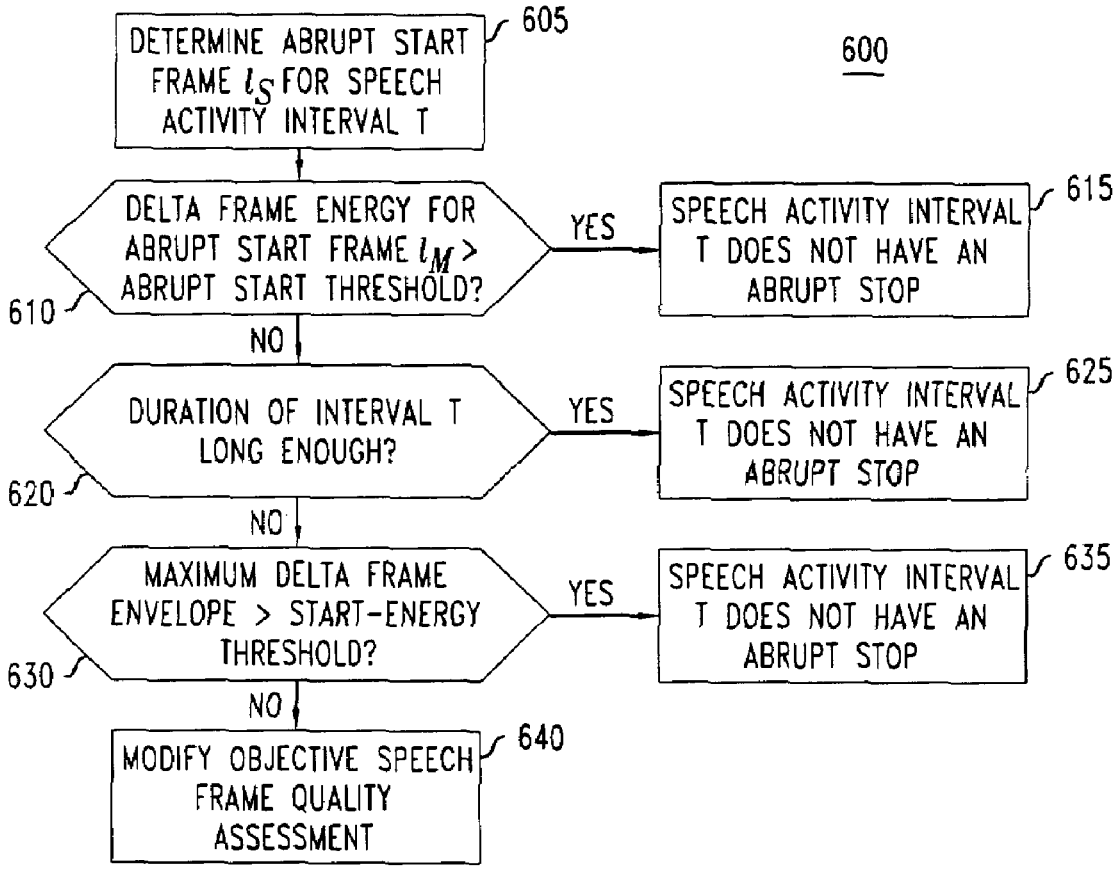
FIG. 6 depicts a flowchart illustrating an embodiment for determining whether speech activity has an abrupt start and for modifying objective speech frame quality assessment $v_s(m)$ when it is determined that such speech activity has an abrupt start.

FIG. 6 depicts a flowchart 600 illustrating an embodiment for determining whether speech activity has an abrupt start and for modifying objective speech frame quality assessment $v_s(m)$ when it is determined that such speech activity has an abrupt start. In step 605, abrupt start frame $l_S$ is determined. The abrupt start frame $l_S$ is determined by first finding positive peaks of delta frame envelope $\Delta e(l)$ in the speech activity using all frames l in interval $T_i$. Delta frame envelope $\Delta e(l)$ has a positive peak at l if $\Delta e(l)>\Delta e(l+j)$ for $3 \leqq j \leqq 3$. Upon finding the positive peaks, abrupt start frame $l_S$ is determined as the maximum of the positive peaks of delta frame envelopes $\Delta e(l)$. In step 610, delta frame envelope $\Delta e(l_S)$ is checked to determined whether an abrupt start threshold value is satisfied. The abrupt start threshold representing a criteria for determining whether there was sufficient positive change in frame envelope from one frame l to another frame l+1 to be considered an abrupt start. In one embodiment, the abrupt stop threshold value is 0.9 and step 601 may be expressed as equation (14):

$$\Delta e(l_S)>0.9 \qquad \text{equation (14)}$$

If delta frame envelope $\Delta e(l_S)$ does not satisfy the abrupt start threshold value, then in step 615 the speech activity is determined not to have an abrupt start.

If delta frame envelope $\Delta e(l_S)$ does satisfy the abrupt start threshold value, then in step 620 interval $T_i$ is checked to determined if the speech activity is of sufficient duration, e.g., longer than a short burst. In one embodiment, the duration of interval $T_i$ is checked to see if it exceeds the short burst threshold value, e.g., 60 ms. That is, if $T_i<60$ ms, then the speech activity associated with interval $T_i$ is not of sufficient duration. If the speech activity is not of sufficient duration, then in step 625 the speech activity is determined not to have an abrupt start.

If the speech activity is of sufficient duration, then in step 630 a maximum frame envelope e(l) is determined for frame $l_S$ or prior through one or more frames after frame $l_S$ and subsequently compared against a start-energy threshold value. The start-energy threshold value representing a criteria for determining whether a frame envelope has sufficient energy. In one embodiment, maximum frame envelope e(l) is determined for frames $l_S$ through $l_S+7$ and compared to a start-energy threshold value of 12, i.e., $$\max_{l_S \le l \le l_S+7} e(l) < 12.$$

If the maximum frame envelope e(l) does not satisfy the start-energy threshold value, then in step 635 the speech activity is determined not to have an abrupt start.

If the maximum frame envelope e(l) does satisfy the start-energy threshold value, then objective speech frame quality assessment $v_s(m)$ is modified in accordance with equation 16 for several frames m, such as $m_M, \ldots, m_M+6$:

$$\tilde{v}_s(m) = \frac{v_s(m)}{1+\exp[-0.4(m-m_S)/\Delta e(l_S)-10]} \qquad \text{equation (16)}$$

where $m_S$ corresponds to the frame m which is impacted most by abrupt start frame $l_S$. It should be understood that the values used in equations (11), (13) and (16) were derived empirically. Other values are possible. Thus, the present invention should not be limited to those specific values.

Note that upon determining modified objective speech frame quality assessment $\tilde{v}_s(m)$, the integration performed in step 145 may be achieved using equation (17):

$$v_s(m)=\min(v_{s,I}(m),v_{s,M}(m),v_{s,S}(m)) \quad \text{equation (17)}$$

where $v_{s,I}(m)$, $v_{s,M}(m)$ and $v_{s,S}(m)$ correspond to the modified objective speech frame quality assessment $\tilde{v}_s(m)$ of equations 11, 13 and 16, respectively.

Although the present invention has been described in considerable detail with reference to certain embodiments, other versions are possible. For example, the orders of the steps in the flowcharts may be re-arranged, or some steps (or criteria) may be deleted from or added to the flowcharts. Therefore, the spirit and scope of the present invention should not be limited to the description of the embodiments contained herein. It should also be understood to those skilled in the art that the present invention may be implemented either as hardware or software incorporated into some type of processor.

I claim:

1. A method for objectively assessing speech quality comprising the steps of:

detecting distortions in an interval of speech activity using envelope information;

modifying an objective speech quality assessment value associated with the speech activity to reflect the impact of the distortions on subjective speech quality assessment; and prior to the step of detecting, determining the interval of speech activity using the envelope information.

2. The method of claim 1, wherein the step of modifying includes the step of determining the objective speech quality assessment value for the speech activity.

3. The method of claim 1, wherein the distortions being detected are impulsive noise, abrupt stop or abrupt start.

4. The method of claim 1, wherein the step of detecting includes the step of determining a distortion type.

5. A method of claim 1, wherein the distortion type is determined to be impulsive noise if the envelope information indicates that the speech activity can be perceived by a human listener to be noise and if the interval is of a duration long enough to be perceived by a human listener but not too long for a short burst.

6. The method of claim 4, wherein the distortion type is determined to be impulsive noise if the envelope information indicates that the speech activity can be perceived by a human listener to be noise, if a ratio of the objective speech quality assessment value to a modulation noise reference unit indicates a human listener would perceive annoying noise, and if the interval is of a duration long enough to be perceived by a human listener but not too long for a short burst.

7. The method of claim 4, wherein the objective speech quality assessment value associated with the speech activity is modified in accordance with the following equation to obtain a modified objective speech quality assessment value if the distortion type is impulsive noise:

$$\tilde{v}_s(m) = \frac{v_s(m)}{1+\exp[-8.2(m-m_I)/\Delta e(l_I)-10]}$$

where $v_s(m)$ is the objective speech quality assessment value, $\tilde{v}_s(m)$ is the modified objective speech quality assessment value, "m" is a frame of the interval of speech activity, "$l_I$" is an impulsive noise frame, "$m_I$" is the frame m impacted most by impulsive noise frame "$l_I$", and "$e(l_I)$" is a frame envelope for impulsive noise frame "$l_I$".

8. The method of claim 4, wherein the distortion type is determined to be abrupt stop if the envelope information indicates that there was an sufficient negative change in frame energy from one frame to another to be considered an abrupt stop and if the interval is of a duration longer than a short burst.

9. The method of claim 4, wherein the distortion type is determined to be abrupt stop if the envelope information indicates that a maximum frame envelope had sufficient energy prior to ending the interval, and if the interval is of a duration longer than a short burst.

10. The method of clam 4, wherein the objective speech quality assessment value associated with the speech activity is modified in accordance with the following equation to obtain a modified objective speech quality assessment value if the distortion type is impulsive noise:

$$\tilde{v}_s(m) = |\Delta e(l_M)|\left[\frac{6}{1+\exp[-2(m-m_M-3]}-6\right]$$

where $v_s(m)$ is the objective speech quality assessment value, $\tilde{v}_s(m)$ is the modified objective speech quality assessment value, "m" is a frame of the interval of speech activity, "$l_M$" is an abrupt stop frame, "$m_M$" is the frame m impacted most by abrupt stop frame "$l_M$", and "$\Delta e(l_M)$" is a delta frame envelope for abrupt stop frame "$l_M$".

11. The method of claim 4, wherein the distortion type is determined to be abrupt start if the envelope information indicates that there was an sufficient positive change in frame energy from one frame to another to be considered an abrupt start and if the interval is of a duration longer than a short burst.

12. The method of claim 4, wherein the distortion type is determined to be abrupt stop if the envelope information indicates that a maximum frame envelope had sufficient energy towards a beginning of the interval, and if the interval is of a duration longer than a short burst.

13. The method of claim 4, wherein the objective speech quality assessment value associated with the speech activity is modified in accordance with the following equation to obtain a modified objective speech quality assessment value if the distortion type is impulsive noise:

$$\tilde{v}_s(m) = \frac{v_s(m)}{1+\exp[-0.4(m-m_S)/\Delta e(l_S)-10]}$$

where $v_s(m)$ is the objective speech quality assessment value, $\tilde{v}_s(m)$ is the modified objective speech quality assessment value, "m" is a frame of the interval of speech activity, "$l_S$" is an abrupt start frame, "$m_S$" is the frame m most impacted by abrupt start frame "$l_S$", and "$\Delta e(l_S)$" is a delta frame envelope for abrupt start frame "$l_S$".

14. An objective speech quality assessment system comprising:

means for detecting distortions in an interval of speech activity using envelope information; and means for modifying an objective speech quality assessment value associated with the speech activity to reflect the impact of the distortions on subjective speech quality assessment, wherein the means for detecting includes a means for determining a distortion type, and the means for detecting includes a voice activity detector for detecting intervals of speech activity, wherein the means for determining a distortion type examines intervals of speech activities detected by the voice activity detector.

15. The objective speech quality assessment system of claim 14, wherein the means for modifying includes a means for determining the objective speech quality assessment values without accounting for distortions for the speech activity.

16. The objective speech quality assessment system of claim 14, wherein the distortion being detected are impulsive noise, abrupt stop or abrupt start.

* * * * *